US010781404B2

(12) United States Patent
Bird et al.

(10) Patent No.: US 10,781,404 B2
(45) Date of Patent: Sep. 22, 2020

(54) CLEANING METHOD, APPARATUS AND USE

(71) Applicant: Xeros Limited, Rotherham, South Yorkshire (GB)

(72) Inventors: Robert Andrew Bird, Rotherham (GB); Gordon Lee Ellis, Rotherham (GB); Martina Schoemer, Ludwigshafen (DE); Simon Kniesel, Weinheim (DE); Philipp Kloke, Mannheim (DE); Frank Ehret, Ellerstadt (DE); Matthias Dietrich, Weinheim (DE)

(73) Assignee: Xeros Limited, Rotherham, South Yorkshire (GB)

( * ) Notice: Subject to any disclaimer, the term of this patent is extended or adjusted under 35 U.S.C. 154(b) by 370 days.

(21) Appl. No.: 15/532,137

(22) PCT Filed: Nov. 30, 2015

(86) PCT No.: PCT/GB2015/053655
§ 371 (c)(1),
(2) Date: Jun. 1, 2017

(87) PCT Pub. No.: WO2016/087834
PCT Pub. Date: Jun. 9, 2016

(65) Prior Publication Data

US 2017/0267949 A1 Sep. 21, 2017

(30) Foreign Application Priority Data

Dec. 1, 2014 (GB) ..... 1421293.0

(51) Int. Cl.

| | |
|---|---|
| ***C11D 3/37*** | (2006.01) |
| ***C11D 3/14*** | (2006.01) |
| ***C11D 11/00*** | (2006.01) |
| ***C11D 17/04*** | (2006.01) |
| ***D06F 35/00*** | (2006.01) |
| ***C11D 3/04*** | (2006.01) |
| ***C11D 3/12*** | (2006.01) |
| ***D06F 39/02*** | (2006.01) |
| ***D06F 39/10*** | (2006.01) |

(52) U.S. Cl.
CPC ..... *C11D 3/3719* (2013.01); *C11D 3/046* (2013.01); *C11D 3/122* (2013.01); *C11D 3/1213* (2013.01); *C11D 3/14* (2013.01); *C11D 3/37* (2013.01); *C11D 11/0017* (2013.01); *C11D 17/04* (2013.01); *D06F 35/00* (2013.01); *D06F 39/02* (2013.01); *D06F 39/10* (2013.01)

(58) Field of Classification Search
CPC ..... C11D 3/3719; C11D 3/046; C11D 3/1213; C11D 3/14; C11D 3/37; C11D 11/0017; C11D 17/04; D06F 35/00; D06F 39/02; D06F 39/10
See application file for complete search history.

(56) References Cited

U.S. PATENT DOCUMENTS

| | | | | |
|---|---|---|---|---|
| 4,360,617 | A | 11/1982 | Muller et al. | |
| 4,493,783 | A | 1/1985 | Su et al. | |
| 5,657,501 | A | 8/1997 | Refai | |
| 5,977,294 | A * | 11/1999 | Hoehn | C08F 6/003 521/40 |
| 8,959,961 | B2 | 2/2015 | Jenkins et al. | |
| 8,974,545 | B2 | 3/2015 | Burkinshaw et al. | |
| 9,017,423 | B2 | 4/2015 | Burkinshaw et al. | |
| 9,121,000 | B2 | 9/2015 | Burkinshaw et al. | |
| 9,127,882 | B2 | 9/2015 | Jenkins et al. | |
| 9,297,107 | B2 | 3/2016 | Jenkins | |
| 9,315,766 | B2 | 4/2016 | He et al. | |
| 9,404,210 | B2 | 8/2016 | He et al. | |
| 9,410,278 | B2 | 8/2016 | He et al. | |
| 9,476,155 | B2 | 10/2016 | He et al. | |
| 9,487,898 | B2 | 11/2016 | He et al. | |
| 9,523,169 | B2 | 12/2016 | Sawford et al. | |
| 9,550,966 | B2 | 1/2017 | Burkinshaw et al. | |
| 9,587,337 | B2 | 3/2017 | He et al. | |
| 9,587,340 | B2 | 3/2017 | Jenkins et al. | |

(Continued)

FOREIGN PATENT DOCUMENTS

| | | |
|---|---|---|
| CN | 102061589 A | 5/2011 |
| CN | 202175862 U | 3/2012 |

(Continued)

OTHER PUBLICATIONS

U.S. Appl. No. 15/510,569, Xeros Ltd.

(Continued)

*Primary Examiner* — Gregory R Delcotto
*Assistant Examiner* — Preeti Kumar
(74) *Attorney, Agent, or Firm* — Clark & Elbing LLP

(57) ABSTRACT

A method for cleaning a substrate which is or comprises a textile, the method comprising agitating the substrate in the presence of a cleaning composition comprising: i. cleaning particles comprising a thermoplastic polyamide and a particulate inorganic filler having a density of at least 2.5 g/cm$^3$, said cleaning particles having an average particle size of from 1 to 100 mm, wherein the cleaning particles have an average density of at least 1.65 g/cm$^3$ and/or the particulate inorganic filler has a $D_{50}$ particle size of at least 10 microns and/or a $D_{90}$ particle size of at least 40 microns; and ii. a liquid medium.

26 Claims, No Drawings

(56) References Cited

U.S. PATENT DOCUMENTS

| | | | |
|---|---|---|---|
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,455 | B2 | 12/2017 | Jenkins et al. |
| 9,850,619 | B2 | 12/2017 | Wells et al. |
| 9,914,901 | B2 | 3/2018 | Burkinshaw et al. |
| 9,932,700 | B2 | 4/2018 | Wells et al. |
| 10,017,895 | B2 | 7/2018 | Wells et al. |
| 10,081,900 | B2 | 9/2018 | Wells et al. |
| 10,287,642 | B2 | 5/2019 | Scott |
| 10,301,691 | B2 | 5/2019 | Feyisa et al. |
| 10,316,448 | B2 | 6/2019 | He et al. |
| 2011/0296628 | A1 | 12/2011 | Jenkins et al. |
| 2012/0048299 | A1 | 3/2012 | Jenkins et al. |
| 2013/0167882 | A1 | 7/2013 | Burkinshaw et al. |
| 2013/0276242 | A1 | 10/2013 | Jenkins et al. |
| 2013/0283542 | A1 | 10/2013 | Jenkins et al. |
| 2014/0201929 | A1 | 7/2014 | He et al. |
| 2014/0283314 | A1 | 9/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0175945 | A1 | 6/2015 | Waddon et al. |
| 2015/0252511 | A1 | 9/2015 | Roberts et al. |
| 2016/0032522 | A1 | 2/2016 | Steele |
| 2016/0040260 | A1 | 2/2016 | Steele |
| 2016/0122932 | A1 | 5/2016 | Wells et al. |
| 2016/0122936 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2016/0251795 | A1 | 9/2016 | Wells et al. |
| 2017/0051447 | A1 | 2/2017 | He et al. |
| 2017/0159222 | A1 | 6/2017 | Jenkins et al. |
| 2017/0240982 | A1 | 8/2017 | Sadeghi |
| 2017/0241061 | A1 | 8/2017 | Wells et al. |
| 2017/0247771 | A1 | 8/2017 | Scott |
| 2018/0057777 | A1 | 3/2018 | Waddon et al. |
| 2018/0127914 | A1 | 5/2018 | Wells et al. |
| 2018/0134994 | A1 | 5/2018 | Steele et al. |
| 2018/0141089 | A1 | 5/2018 | Sawford et al. |
| 2018/0216049 | A1 | 8/2018 | Bird et al. |
| 2019/0144959 | A1 | 5/2019 | Ashfaq et al. |
| 2019/0210892 | A1 | 7/2019 | Scott et al. |
| 2019/0211288 | A1 | 7/2019 | Potts et al. |
| 2019/0233760 | A1 | 8/2019 | Lavery et al. |

FOREIGN PATENT DOCUMENTS

| | | | |
|---|---|---|---|
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202492706 | U | 10/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 103225192 | A | 7/2013 |
| CN | 203049283 | U | 7/2013 |
| CN | 103361934 | A | 10/2013 |
| CN | 103361938 | A | 10/2013 |
| CN | 203370359 | U | 1/2014 |
| CN | 102061588 | B | 2/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 205329373 | U | 6/2016 |
| CN | 205329374 | U | 6/2016 |
| CN | 205329380 | U | 6/2016 |
| CN | 205329384 | U | 6/2016 |
| DE | 2702661 | A1 | 8/1977 |
| DE | 10313681 | A1 | 10/2004 |
| DE | 102008001547 | A1 | 11/2008 |
| EP | 0038094 | A2 | 10/1981 |
| EP | 0038582 | A2 | 10/1981 |
| EP | 0039524 | A1 | 11/1981 |
| EP | 0129195 | A2 | 12/1984 |
| EP | 0129196 | A2 | 12/1984 |
| EP | 0922065 | B1 | 11/2002 |
| EP | 1198491 | B1 | 10/2003 |
| WO | WO-2004080679 | A1 | 9/2004 |
| WO | WO-2007128962 | A1 | 11/2007 |
| WO | WO-2010/094959 | A1 | 8/2010 |
| WO | WO-2010/128337 | A2 | 11/2010 |
| WO | WO-2011/064581 | A1 | 6/2011 |
| WO | WO-2011/098815 | A1 | 8/2011 |
| WO | WO-2012/035342 | A1 | 3/2012 |
| WO | WO-2012/035343 | A1 | 3/2012 |
| WO | WO-2012/056252 | A2 | 5/2012 |
| WO | WO-2012/095677 | A2 | 7/2012 |
| WO | WO 2014/006425 | A1 * | 1/2014 |
| WO | WO-2014/006425 | A1 | 1/2014 |
| WO | WO-2014/147390 | A1 | 9/2014 |
| WO | WO 2015/004444 | A1 * | 1/2015 |
| WO | WO-2015/004444 | A1 | 1/2015 |
| WO | WO-2016/087351 | A1 | 6/2016 |

OTHER PUBLICATIONS

U.S. Appl. No. 15/510,576, Xeros Ltd.
U.S. Appl. No. 15/513,014, Xeros Ltd.
U.S. Appl. No. 15/513,309, Xeros Ltd.
U.S. Appl. No. 15/518,047, Xeros Ltd.
Costa et al., "Complexes of Copper (I) with Triphenylphosphine," J Inorg Nucl Chem. 27: 2581-2584 (1965).

(56) References Cited

OTHER PUBLICATIONS

International Search Report and Written Opinion for International Application No. PCT/GB2015/053655, dated Feb. 5, 2016 (10 pages).
Jardine et al., "The Chemistry of Copper (I) Complexes. Part I. Halogeno-complexes," J Chem Soc. (A): 238-240 (1970).
Search Report for United Kingsom Application No. GB1421293.0, dated May 18, 2015 (4 pages).
Stojanovic et al., "Determination of Particle Size Distributions by Laser Diffraction," Technics—New Materials. 21:11-20 (2012).
U.S. Appl. No. 16/093,398, Xeros Ltd.
U.S. Appl. No. 16/093,433, Xeros Ltd.
U.S. Appl. No. 16/318,192, Xeros Ltd.
U.S. Appl. No. 16/481,583, Xeros Ltd.
U.S. Appl. No. 16/497/070, Xeros Ltd.

* cited by examiner

CLEANING METHOD, APPARATUS AND USE

FIELD OF THE INVENTION

The present invention relates to a method for cleaning a substrate which is or comprises a textile. The method is particularly suited to cleaning laundry. The present invention also relates to an apparatus suitable for performing the method. The present invention further relates to the use of novel cleaning particles for cleaning a substrate which is or comprises a textile.

BACKGROUND TO THE INVENTION

PCT patent publication WO2012/056252 discloses methods for cleaning a soiled substrate (such as a textile) using a solid particulate material (cleaning particles) having an average density of from 0.5 to 2.5 g/cm$^3$. This patent publication exemplifies cleaning particles having an average density of up to 1.88 g/cm$^3$ for polyamide. The patent publication does not mention how such a density was achieved. The patent publication makes no mention of particulate fillers being present in the cleaning particles. The patent publication discloses that a wide array of factors including cleaning particle size, shape and density and method factors such as drum perforations and rotation speed affect the recovery of the cleaning particles after each washing cycle. Typical thermoplastic polyamides tend to have a low density of around 1.1 to 1.4 g/cm$^3$. Polyamides such as Nylon 6 and Nylon 6,6 have especially low densities of around 1.15 g/cm$^3$.

Whilst PCT publication WO2012/056252 provides excellent cleaning and separation performance, the present invention seeks to address, at least in part, one or more of the following technical objectives:

i. further improving the separation of the cleaning particles at the end of the cleaning procedure;

ii. further improving the cleaning performance, especially for difficult stains such as sebum and oil/soot; and/or iii. providing a method utilising cleaning particles which can be readily and cost effectively recycled.

Furthermore, it is desired that in addressing the above technical problems the mechanical action imparted to the textile substrate by the cleaning particles is not so high as to significantly reduce fabric care performance.

SUMMARY OF THE INVENTION

The present invention derives from the finding that the above technical problems can be addressed, at least in part, by a cleaning method which utilises cleaning particles comprising a thermoplastic polyamide and a particulate inorganic filler having a density of at least 2.5 g/cm$^3$, said cleaning particles having an average particle size of from 1 to 100 mm, wherein the cleaning particles have an average density of at least 1.65 g/cm$^3$ and/or the particulate inorganic filler has a $D_{50}$ particle size of at least 10 microns and/or a $D_{90}$ particle size of at least 40 microns. Without wishing to be limited by any particular theory it is believed that cleaning particles with a higher density separate better from the cleaned substrate at the end of the cleaning procedure and that using a dense filler achieves this very effectively whilst still permitting the use of low density nylon thermoplastics which offer excellent cleaning characteristics and recyclability. Furthermore, the use of inorganic filler particles having a $D_{50}$ size of at least 10 microns and a $D_{90}$ size of at least 40 microns permits higher proportions of inorganic filler to be incorporated into the thermoplastic resin without affecting the particle melt rheology and final morphology so adversely that it becomes difficult or impractical to find suitable methods for preparing the cleaning particles, especially in the more desired shapes such as ellipsoids and spheres and at the smaller sizes such as from 1 to 10 mm in length.

According to a first aspect of the present invention there is provided a method for cleaning a substrate which is or comprises a textile, the method comprising agitating the substrate in the presence of a cleaning composition comprising:

i. cleaning particles comprising a thermoplastic polyamide and a particulate inorganic filler having a density of at least 2.5 g/cm$^3$, said cleaning particles having an average particle size of from 1 to 100 mm, wherein the cleaning particles have an average density of at least 1.65 g/cm$^3$ and/or the particulate inorganic filler has a $D_{50}$ particle size of at least 10 microns and/or a $D_{90}$ particle size of at least 40 microns; and ii. a liquid medium.

Thus, the present invention provides a method for cleaning a substrate which is or comprises a textile, the method comprising agitating the substrate in the presence of a cleaning composition comprising:

i. cleaning particles comprising a thermoplastic polyamide and a particulate inorganic filler having a density of at least 2.5 g/cm$^3$, said cleaning particles having an average particle size of from 1 to 100 mm, wherein the cleaning particles have an average density of at least 1.65 g/cm$^3$; and ii. a liquid medium.

The present invention further provides a method for cleaning a substrate which is or comprises a textile, the method comprising agitating the substrate in the presence of a cleaning composition comprising:

i. cleaning particles comprising a thermoplastic polyamide and a particulate inorganic filler having a density of at least 2.5 g/cm$^3$, said cleaning particles having an average particle size of from 1 to 100 mm, wherein the particulate inorganic filler has a $D_{50}$ particle size of at least 10 microns and/or a $D_{90}$ particle size of at least 40 microns; and ii. a liquid medium.

Preferably, the particulate inorganic filler has a $D_{50}$ particle size of at least 10 microns and a $D_{90}$ particle size of at least 40 microns Most preferably, the present invention provides a method for cleaning a substrate which is or comprises a textile, the method comprising agitating the substrate in the presence of a cleaning composition comprising:

i. cleaning particles comprising a thermoplastic polyamide and a particulate inorganic filler having a density of at least 2.5 g/cm$^3$, said cleaning particles having an average particle size of from 1 to 100 mm, wherein the cleaning particles have an average density of at least 1.65 g/cm$^3$ and the particulate inorganic filler has a $D_{50}$ particle size of at least 10 microns and/or (and preferably and) a $D_{90}$ particle size of at least 40 microns; and ii. a liquid medium.

Textile Substrate

The word textile as used herein preferably means a woven material comprising fibres, typically fibres which are twisted into a yarn.

The substrate may be in the form of, for example, towels, clothes, sheets, footwear or bags. Examples of suitable clothes include shirts, trousers, skirts, coats, socks, jumpers and the like.

The textile can be made from fibres of any suitable material; preferably the textile is or comprises one or more fibres made of wool, cellulose, silk, nylon, polyester or acrylic.

The substrate is preferably soiled. Examples of soil contaminants include: body fluids and body products (e.g. blood, sweat, grime, sebum), grass, food (e.g. egg, chocolate, curry, wine, flour, tomato), drink (especially fruit juices, coffee and tea), mud, ink (e.g. from pens and felt tips), cosmetics (makeup) and oils (e.g. motor oil).

Thermoplastic Polyamide

The term thermoplastic as used herein preferably means a polymer which is moldable or pliable when heated above a certain temperature. It is especially preferred that the thermoplastics used in the present invention can be hot melt blended with the particulate inorganic filler and that the resulting material can be extruded. Some (small) degree of cross-linking of the thermoplastic polymer is possible provided that the material still behaves as a thermoplastic.

Preferably, the cleaning particles comprise in order of increasing preference at least 40 v %, 45 v %, 50 v % and 55 v % of polyamide. The present inventors have found that if too little thermoplastic polyamide is present it becomes difficult to prepare cleaning particles having a desirable shape, especially spheres and ellipsoids. In addition the cleaning particles may become friable when too little polyamide is present in the cleaning particles. Preferably, in order of increasing preference the cleaning particles comprise no more than 90 v %, 85 v %, 80 v %, 75 v %, 70 v %, 65 v % and 60 v % of polyamide. The present inventors have found that if too much polyamide is present it becomes difficult to obtain cleaning particles having the preferred average densities as mentioned below and thereby the more preferred separation and cleaning performance characteristics are not as well achieved. The volume % of polyamide in the particle can be determined by suitable analytical tools conventional in the art, and/or derived from determination of the mass % of the polyamide in the particle and the density thereof, again using suitable analytical tools conventional in the art. Suitable methods for establishing the volume % of polyamide in the cleaning particles include ashing and solvent extraction, preferably ashing. In ashing, a known volume of cleaning particles is burnt in air to form an ash. The ashing is preferably performed in air at a temperature of above 500° C. Any of the known standard test methods can be applied including those disclosed in ASTM $D_{2584}$, $D_{5630}$ and ISO 3451, and preferably the test method is conducted according to ASTM $D_{5630}$. The initial $V_I$ and final ashed $V_{FA}$ volumes can be established by pycnometry, preferably by helium gas pycnometry. The volume % of polyamide can be given by $(V_I-V_{FA})/V_I$. One suitable example of a pycnometer is that sold by Micromeritics as the Quantachrome micropycnometer. A preferred pycnometer method used throughout the present invention is DIN ISO 1183-1:2012. Solvent extraction can be performed on a known volume of cleaning particles. Preferred solvents include concentrated sulphuric acid, resorcinol, cresol, phenol, chlorophenol, xylenols and especially formic acid. The cleaning particles can be extracted under reflux using the solvent, typically for around 16 hours. The remaining unextracted material can be dried. The volume of the initial $V_I$ and the dried unextracted $V_{UE}$ material can be determined by pycnometry, especially helium pycnometry. The volume % of the polyamide is then given by $(V_I-V_{UE})/V_I\times100$.

Preferably, the cleaning particles comprise at least 10 wt %, more preferably at least 15 wt %, even more preferably at least 20 wt % and most preferably at least 25 wt % of polyamide. Preferably, the cleaning particles comprise in order of increasing preference no more than 70 wt %, 65 wt %, 60 wt %, 55 wt %, 50 wt %, 45 wt % and 40 wt % of polyamide. These preferences are especially suitable for inorganic fillers having a density of about 4 g/cm$^3$ to 5 g/cm$^3$; for example barium sulfate (which typically has a density of around 4.5 g/cm$^3$). The wt % is preferably established by ashing or by solvent extraction as mentioned above but in this case measuring the initial and final weights of the cleaning particles. Another suitable method is thermogravimetric analysis. Preferably the method is ashing, as described above.

It has been found that thermoplastic polyamides can form the preferred shapes such as spheres and ellipsoids. Polyamides also offer the advantage that they are relatively inert and hydrolytically stable over a broad pH range. The polyamide can be selected from any of those known in the art. As used herein the word polyamide preferably means homo and copolymers of monomers which when polymerised result in polymers containing a multiplicity of amide groups. The polyamide can be an aromatic or more preferably an aliphatic polyamide. Typical examples of aliphatic polyamides include nylon-6 (polycaprolatam), nylon-6,6 (polyhexamethyleneadipamide), nylon-4,6 (polytetramethyleneadipamide), nylon-5,10 (polypentamethyleneadipamide), nylon-6,10 (polyhexamethylenesebacamide), nylon-7 (polyenantholactam), nylon-11 (polyundecanolactam) and nylon-12 (polydodecanolactam). Of these nylon-6, nylon 6,6 or a mixture thereof are preferred.

The polyamides can be prepared by synthetic methods well known in the art including the copolymerisation of diamines with dicarboxylic acids and/or diacid chlorides. Alternatively, polyamides can be prepared by the ring opening of a cyclic lactam, e.g caprolactam.

The cleaning particles may comprise a single thermoplastic polyamide or two or more polyamides.

Inorganic Filler

The particulate inorganic filler material preferably is or comprises one or more fillers selected from a metal salt, a metal oxide, a metal sulfide, a metal carbide, a metal nitride, a ceramic, a metal, an alloy and combinations thereof. The inorganic filler preferably is or comprises a metal oxide, a metal sulfide, a metal salt, a metal or an alloy, more preferably is or comprises a metal oxide, a metal sulfide, or a metal salt and especially is or comprises a metal salt.

Preferred metals include barium, bismuth, chromium, cadmium, copper, cobalt, gold, iron, iridium, lead, molybdenum, nickel, osmium, palladium, platinum, silver, tungsten and tin.

Preferred alloys include bronze, brass, rose metal, steel and ferro alloys, pewter, solder, nichrome and constantan.

Preferred metal salts are in the form of nitrate, carbonate, hydrogencarbonate, hydroxide, phosphate, silicate, hydrogen phosphate, halide (especially fluoride, chloride, bromide and iodide), acetate and sulfate.

Suitable metal salts include calcium silicate (especially wollastanite), calcium carbonate (especially chalk), magnesium silicate (especially talc) and barium sulfate (especially barite). A particularly preferred metal salt is barium sulfate.

Suitable metal oxides include iron oxide (especially magnetite), bismuth oxide, titanium oxide, aluminium oxide, silicon dioxide (especially quartz).

Preferred metal sulfides include zinc and especially lithopone (which comprises barium sulfate and zinc sulfide). Lithopone is prepared by co-precipitating zinc sulfide and barium sulfate, most commonly in equimolar amounts.

In view of the foregoing the particulate inorganic filler preferably is or comprises barium sulfate and/or zinc sulfide.

Preferably, the inorganic filler has a Mohr's hardness of less than 8, more preferably less than 7, yet more preferably less than 6, even more preferably less than 5 and especially less than 4. For reference diamond has a Mohr hardness of 10, barium sulfate has a Mohr hardness of 3 and gypsum has a Mohr hardness of 2. The use of inorganic fillers with a relatively low Mohr's hardness helps in several respects. Firstly, the use of low hardness inorganic fillers is thought to help to prevent undesirable abrasion on the textile substrate which would tend to cause damage to the textile. In addition, the use of low hardness inorganic fillers is of assistance in hot melt mixing and extrusion of the filler with the polyamide as it reduces or prevents the tendency for the filler to abrade, wear or damage the apparatus used to mix and extrude these materials.

The particulate inorganic filler is preferably substantially insoluble in the liquid medium, more preferably substantially insoluble in water.

Preferably, the cleaning particles comprise in order of increasing preference at least 10 v %, 15 v %, 20 v %, 25 v %, 30 v %, 35 v % and 40 v % of the particulate inorganic filler. The present inventors have found that these amounts of filler provide cleaning particles which demonstrate good separation and cleaning performance. Preferably, the cleaning particles comprise in order of increasing preference no more than 60 v %, 55 v %, 50 v %, 45 v % of the particulate inorganic filler.

Preferably, the cleaning particles comprise no more than 90 wt %, more preferably no more than 85 wt %, even more preferably no more than 80 wt % and especially no more than 75 wt % of the particulate inorganic filler. Preferably, the cleaning particles comprise in order of increasing preference at least 41 wt %, 45 wt %, 50 wt %, 55 wt %, 60 wt %, 65 wt % and 70 wt % of the particulate inorganic filler. These preferences are especially suitable for inorganic fillers having a density of about 4 g/cm$^3$ to 5 g/cm$^3$; for example barium sulfate (which typically has a density of around 4.5 g/cm$^3$).

The density of the particulate inorganic filler is, to a large extent, determined by the chemical identity of the filler material. Preferably, the inorganic filler has a density of at least 2.7 g/cm$^3$, more preferably 3.0 g/cm$^3$, even more preferably at least 3.5 g/cm$^3$ and especially at least 4.0 g/cm$^3$. A preferred method for establishing the density of the inorganic filler comprises i. ashing the cleaning particles (by the methods as previously described); ii. weighing the mass of the remaining ash and iii. establishing the volume of the remaining ash by pycnometry, especially helium pycnometry. The preferred apparatus for which is as described above. The density is then simply the mass in g divided by the volume in cm$^3$.

In some embodiments the density of the particulate inorganic filler can be higher still for example the density can be at least 5 g/cm$^3$, at least 6 g/cm$^3$, or at least 7 g/cm$^3$. These higher densities are more readily obtained from particulate inorganic fillers such as metals, metal alloys and metal oxides.

Preferably, the density of the particulate inorganic filler is no more than 20 g/cm$^3$, more preferably no more than 15 g/cm$^3$ and especially no more than 10 g/cm$^3$. Where the particulate inorganic filler is or comprises metal salt(s), the density of the particulate inorganic filler is preferably no more than 7 g/cm$^3$, preferably no more than 5 g/cm$^3$.

Preferably, the particulate inorganic filler has a $D_{50}$ particle size which is, in increasing order of preference, at least 10, 11 and 12 microns. The particulate inorganic filler preferably also has a $D_{50}$ particle size which is, in order of increasing preference no more than 50, 30, 25, 23, 20, 19, 18, 17, 16, and 15 microns.

In an alternative preferred embodiment, the particulate inorganic filler has a $D_{50}$ particle size which is at least 20, 30, 40, 50, 60, 70, 80, 90 and 100 microns, and in this embodiment the particulate inorganic filler preferably has a $D_{50}$ particle size which is, in order of increasing preference no more than 1000 microns, 500 microns, 300 microns and 200 microns.

The $D_{50}$ particle size is preferably a volume parameter, i.e. a $D_{(v,50)}$. The method of establishing the $D_{50}$ is preferably by laser diffraction (Fraunhofer diffraction). A particularly preferred method utilises a Mastersizer (e.g. a 3000) available from Malvern. In the measurement method, the particulate inorganic filler is preferably dispersed in a liquid medium (especially water) and the preferred dispersal method is 30 seconds of ultrasonication. A particularly suitable measurement method is described in Technics—Materials 21 (2012) 11-20.

The $D_{90}$ particle size is preferably, in order of increasing preference, no more than 1000, 500, 300, 200, 150, 120, 100, 90, 80 and 70 microns. The $D_{90}$ particle size is preferably in order of increasing preference, at least 45, at least 50, at least 55 and at least 60 microns. The method for measuring the $D_{90}$ is the same as that for measuring the $D_{50}$ as described above. The $D_{90}$ is also preferably a volume parameter, i.e. $D_{(v,90)}$.

Preferably, the particulate inorganic filler has a broad particle size distribution. Especially preferred particulate inorganic fillers have a particle size distribution such that the span is at least 2.5, preferably at least 3.5, and most preferably at least 4.0. The span of the particle size distribution is calculated from the $D_{10}$, $D_{50}$ and $D_{90}$ values as $(D_{90}-D_{10})/D_{50}$. $D_{10}$ is measured in accordance with the measurement of the $D_{50}$ and $D_{90}$ values described above. $D_{10}$ is also preferably a volume parameter, i.e. $D_{(v,10)}$.

The present inventors have found that the use of particulate inorganic fillers having the above $D_{50}$, $D_{90}$ characteristics, and preferably also the span characteristics, affords cleaning particles with much improved shape characteristics which are particularly suitable for laundry applications.

Cleaning Particles

The cleaning particles preferably have an average size which is, in order of increasing preference, of no more than 50 mm, 40 mm, 30 mm, 20 mm, 10 mm, 8 mm and 6 mm. The cleaning particles preferably have an average particle size of at least 2 mm, more preferably at least 3 mm and especially at least 4 mm. The average size is preferably determined by measuring the largest linear dimension of each particle using, for example, a vernier caliper and then calculating a number average.

The cleaning particles can be in the form of a sphere, ellipsoid, cylinder or cuboid. Exact mathematical adherence to the form a sphere or ellipsoid etc is not required. Instead words such as sphere, ellipsoid are preferably meant to indicate that the shape largely fits these idealised forms. One preferred method for preparing the cleaning particles comprises extruding a molten mixture of the thermoplastic polyamide and the particulate inorganic filler into liquid and repeatedly cutting the extruded material. Extrusion followed by cutting is generally referred to as pelletizing. This preparation process results in cleaning particles which can be cylindrical, ellipsoidal, spherical and all the shapes that exist as intermediates between these. Thus, for example, it is possible to prepare cleaning particles with a shape which is intermediate between a cylinder and an ellipsoid or which is intermediate between an ellipsoid and a sphere.

The present inventors have found that providing cleaning particles having the preferred shape whilst incorporating particulate inorganic filler materials is not always so readily achievable. In general, it was found that as the relative amount of particulate inorganic filler: thermoplastic polyamide increased, the shape control became more difficult. Several shape problems were encountered which included:

i. Snake skinning (this is a roughening of the particle surface having, broadly speaking, a surface which is reminiscent of the skin of a snake);
ii. Tailing (this is the formation of relatively small and often fine and undesirably friable tails on the particle typically where the cutter has cut the surface of the extruded material during pelletizing);
iii. Cutting edges (these are edges which appear as a result of cutting in the pelletizing process);
iv. Particle shape variation (it is preferred that all of particles have a shape which is substantially the same).

Preferably, the cleaning particles are substantially free of such shape problems.

Surprisingly, it was found that by increasing the $D_{50}$ particle size of the particulate inorganic filler to at least 10 microns and/or by increasing the $D_{90}$ particle size of the inorganic filler to at least 40 microns the shape control of the cleaning particles could be improved and the abovementioned problems could be substantially reduced, thereby addressing the technical objectives of the invention.

The cleaning particles preferably have an average density, in order of increasing preference, of at least 1.5 g/cm$^3$, 1.6 g/cm$^3$, 1.65 g/cm$^3$, 1.67 g/cm$^3$ 1.7 g/cm$^3$, 1.75 g/cm$^3$ 1.8 g/cm$^3$, 1.85 g/cm$^3$ 1.9 g/cm$^3$, 1.95 g/cm$^3$, 2.0 g/cm$^3$, 2.05 g/cm$^3$, 2.1 g/cm$^3$, 2.15 g/cm$^3$ and 2.20 g/cm$^3$ In a preferred embodiment, the cleaning particles have an average density, in order of increasing preference, of at least 1.65 g/cm$^3$, 1.67 g/cm$^3$ 1.7 g/cm$^3$, 1.75 g/cm$^3$ 1.8 g/cm$^3$, 1.85 g/cm$^3$ 1.9 g/cm$^3$, 1.95 g/cm$^3$, 2.0 g/cm$^3$, 2.05 g/cm$^3$, 2.1 g/cm$^3$, 2.15 g/cm$^3$ and 2.20 g/cm$^3$.

One method suitable for establishing the density of the cleaning particles is by weighing an amount of particles and then determining the volume of liquid (typically water with a little surfactant) which is displaced by the same amount of particles. The surfactant is typically sodium lauryl sulfate. The amount of surfactant used is typically a 1% w/w solution in water. Preferably, however, the density of the particles is measured by establishing the volume by pycnometry, preferably helium pycnometry, as described previously and using the preferred apparatus mentioned above, preferably according to DIN ISO 1183-1:2012.

The present inventors have observed that cleaning particles with a density which is high can become difficult to pump vertically against gravity, especially in the preferred washing apparatus. Accordingly, it is preferred that the cleaning particles have a density of no more than 5 g/cm$^3$, more preferably no more than 4 g/cm$^3$, even more preferably no more than 3.5 g/cm$^3$ especially no more than 3 g/cm$^3$ and most especially no more than 2.5 g/cm$^3$.

The cleaning particles preferably have an aspect ratio, in order of increasing preference, of less than or equal to 1.5, 1.4, 1.3, 1.28, 1.25, 1.22, 1.20, 1.17, 1.15 and 1.12. Of course, the lowest possible aspect ratio is 1.0. These ratios correspond to a shape which is more smooth and ellipsoidal/spherical and which separates better and the end of the wash cycle. The aspect ratio is calculated by measuring the largest and the smallest linear dimensions for each particle. From this an aspect ratio for each particle can be calculated and the number average of many particles can then be taken. The preferred method for measuring the particle largest and smallest linear dimension is by using a vernier caliper.

Preferably, the number average size or aspect ratio of the cleaning particles are the result of measurements from at least 10, more preferably at least 20 and most preferably at least 30 cleaning particles.

Preferably, the cleaning particles have an average density of at least 1.65 g/cm$^3$ and the particulate inorganic filler has a $D_{50}$ particle size of at least 10 microns and/or (though more preferably "and") a $D_{90}$ particle size of at least 40 microns, wherein the cleaning particles comprise no more than 80 wt % and at least 55 wt % of the particulate inorganic filler, especially when the cleaning particles are spherical or ellipsoidal in shape.

Process for Preparing the Cleaning Particles

The cleaning particles can be prepared by any number of suitable methods conventional in the art. Preferably, the cleaning particles are prepared by a process which comprises extrusion, especially extrusion of a mixture comprising the polyamide and the particulate inorganic filler. Preferably, the extrusion is performed at elevated temperatures so that the mixture is fluid. The extrusion is typically performed by forcing the mixture of polyamide and the particulate inorganic filler through a die having one or more holes.

The extruded material is preferably cut to the desired size using one or more cutters. The combination of extrusion and cutting is generally termed pelletizing. It is especially preferred that the pelletizing is underwater pelletizing, for example as outlined in WO2004/080679.

Preferably, the extrusion is performed such that the extruded material enters a cutting chamber containing a liquid coolant. The coolant preferably is or comprises water but can alternatively be a monohydric or polyhydric alcohol, a glycol or a paraffin. The cutting chamber may be at atmospheric or elevated pressure. Preferably, the cutting is performed as the extruded material enters the cutting chamber containing a liquid coolant. The coolant preferably has a temperature of from 60 to 130° C., more preferably from 70 to 100° C. and especially from 80 to 98° C.

The cutting chamber may be pressurized to a pressure of up to 10 bar, more preferably up to 6 bar, even more preferably from 1 to 5 bar, yet more preferably from 1 to 4 bar, especially preferably from 1 to 3 bar and most especially from 1 to 2 bar.

Cutting is preferably performed by one or more knife heads which typically can rotate at speeds of from 300 to 5000 revolutions per minute.

The time between the extrudate exiting the die and it being cut is typically in the order of milliseconds. Preferred times are not more than 20, more preferably not more than 10 and especially not more than 5 milliseconds.

The temperature of the extruded material directly after exiting the die (exit temperature) is typically from 150 to 350° C., more preferably from 180 to 320° C. and even more especially from 200 to 300° C. Preferably, the temperature of the extrudate at the time of cutting is not than 20° C. below the exit temperatures mentioned directly above.

Prior to extrusion it is typically advantageous to homogeneously mix the thermoplastic polyamide and the particulate inorganic filler. The mixing is preferably performed in mixers such as screw extruders, twin screw extruders, Brabender mixers, Banbury mixers and kneading apparatus. Typically the mixing is performed at high temperatures, typically from 240 to 350° C., more typically from 245 to 310° C. The time required for mixing is typically from 0.2 to 30 minutes.

The cleaning particles may comprise optional additives. Suitable optional additives include: stabilisers, lubricants, release agents, colorants, nucleators and plasticizers.

The stabilisers can be thermal stabilisers (e.g. antioxidants) and/or UV stabilisers.

After preparation the cleaning particles can be dried by any suitable method including centrifugal and fluidized bed drying.

Liquid Medium

The liquid medium can comprise water (aqueous), an organic liquid or a mixture thereof. Preferably the liquid medium is or comprises water. Preferably, the liquid medium comprises water and less than 30 wt %, more preferably less than 20 wt %, even more preferably less than 10 wt % and especially less than 5 wt % of one or more organic liquids. In a preferred embodiment the liquid medium comprises water and no organic liquids.

Optional Components in the Cleaning Composition

The cleaning composition may also comprise one or more optional additives. Thus, the cleaning composition may optionally include, for example, one or more bases, buffers, detergents, surfactants, anti-foaming agents, builders, chelating agents, dye transfer inhibiting agents, enzymes, enzyme stabilizers, bleaching agents, catalytic materials, bleach activators, and clay soil removal agents.

Preferably, the cleaning composition comprises at least one surfactant. The surfactant may be anionic, cationic, zwitterionic or non-ionic.

The total amount of all the optional additives present in the cleaning composition is typically from 0.1 wt %, from 1 wt %, or even from 2 wt % of the liquid medium mass. The total amount of all the optional additives present in the cleaning composition is typically no more than 20 wt %, more typically no more than 15 wt % and especially no more than 10 wt % of the liquid medium mass.

Preferably, the amount of surfactant present in the cleaning composition is at least 0.01 wt %, more preferably at least 0.1 wt % of the liquid medium mass. The amount of surfactant present in the cleaning composition is preferably no more than 10 wt %, more preferably no more than 5 wt % and especially no more than 3 wt %.

Cleaning

The cleaning method of the present invention agitates the substrate in the presence of the cleaning composition. The agitation may be in the form of shaking, stirring, jetting and tumbling. Of these tumbling is especially preferred. Preferably, the substrate and cleaning composition are placed into a rotatable cleaning chamber which is rotated so as to cause tumbling.

The agitation may be continuous or intermittent. Preferably, the method is performed for a period of from 1 minute to 10 hours, more preferably from 5 minutes to 3 hours and even more preferably from 20 minutes to 2 hours.

The method according to the first aspect of the present invention is preferably performed at a temperature of from 5 to 95° C., more preferably from 10 to 90° C., even more preferably from 15 to 70° C., and advantageously from 15 to 50° C. or 15 to 40° C.

The method according to the first aspect of the present invention has been found to be especially effective at cleaning stains such as sebum (which is primarily composed of triglycerides) and soot/mineral oil.

Optional Process Steps

The method according to the first aspect of the present invention may additionally comprise one or more of the steps including: separating the cleaning particles from the cleaned substrate; rinsing the cleaned substrate and drying the cleaned substrate.

Preferably, the cleaning particles are re-used in further cleaning procedures according to the first aspect of the present invention. Typically, the cleaning particles can be re-used for at least 2, more preferably at least 5, even more preferably at least 10, yet more preferably at least 50 and especially at least 100 cleaning procedures according to the first aspect of the present invention. Accordingly, it is preferred that the method of the present invention additionally comprises: separating the cleaning particles from cleaned substrate. Preferably, the cleaned particles are stored in a particle storage tank for use in the next cleaning procedure.

The method according to the first aspect of the present invention may comprise the additional step of rinsing the cleaned substrate.

Rinsing is preferably performed by adding a rinsing liquid medium to the clean substrate. The rinsing liquid medium preferably is or comprises water. Optional post-cleaning additives which may be present in the rinsing liquid medium include optical brightening agents, fragrances and fabric softeners.

Apparatus

According to a second aspect of the present invention there is provided an apparatus suitable for performing the method according to the first aspect of the present invention comprising a rotatable cleaning chamber and a particle storage tank suitable for containing the cleaning particles as defined in the first aspect of the present invention. It will be appreciated that preferably the particle storage tank contains the cleaning particles as defined in the first aspect of the present invention. The cleaning particles are defined in part i. of the first aspect of the present invention.

Preferably the apparatus comprises one or more of the following components:

i. a controller;
ii. a display;
iii. a solenoid valve;
iv. a pneumatic valve.

The apparatus preferably comprises a controller. The controller is preferably configured such that the user can select a desired cleaning cycle and/or desired cleaning conditions and the controller then automatically controls the washing apparatus so as to perform the desired cycle and/or to achieve the desired cleaning conditions. The controller is preferably an electronic controller.

The apparatus preferably comprises a display. The display is preferably an electronic display. Examples of suitable displays include those incorporating liquid crystal and light-emitting diode displays. Preferably the display shows information including for example the cleaning cycle and/or cleaning conditions selected by the user on the controller. Preferably, the apparatus comprises a controller and a display.

The apparatus can comprise one or more solenoid valves and/or one or more pneumatic valves. These valves can control, for example, the entry of clean liquid medium into the apparatus, the exit of dirty liquid medium from the apparatus and/or the introduction of optional components in the cleaning composition (such as detergent) to the substrate.

Thus, the second aspect of the present invention provides an apparatus suitable for performing the method according to the first aspect of the present invention comprising a rotatable cleaning chamber and a particle storage tank suitable for containing cleaning particles comprising a thermoplastic polyamide and a particulate inorganic filler having a density of at least 2.5 g/cm$^3$, said cleaning particles having an average particle size of from 1 to 100 mm, wherein the cleaning particles have an average density of at least 1.65 g/cm$^3$ and/or the particulate inorganic filler has a $D_{50}$ particle size of at least 10 microns and/or the a $D_{90}$ particle size of at least 40 microns.

The rotatable cleaning chamber is preferably a drum which is preferably provided with perforations which allow the cleaning particles to pass through the drum.

The apparatus preferably additionally comprises a pump for transferring the cleaning particle into the cleaning chamber.

The preferred apparatus according to the second aspect of the present invention is as described in WO2011/098815 wherein the second lower chamber comprises the cleaning particles as defined in the first aspect of the present invention.

Use

According to a third aspect of the present invention there is provided the use of the cleaning particles as defined in the first aspect of the present invention for cleaning a substrate which is or comprises a textile.

Thus, the third aspect of the present invention provides the use of cleaning particles comprising a thermoplastic polyamide and a particulate inorganic filler having a density of at least 2.5 g/cm$^3$, said cleaning particles having an average particle size of from 1 to 100 mm, wherein the cleaning particles have an average density of at least 1.65 g/cm$^3$ and/or the particulate inorganic filler has a $D_{50}$ particle size of at least 10 microns and/or a $D_{90}$ particle size of at least 40 microns, for cleaning a substrate which is or comprises a textile.

The particles as defined in the first aspect of the present invention can be used for cleaning methods and apparatus as described, for example in: WO2007/128962, WO2010/094959, WO2011/064581, WO2011/098815, WO2010/128337, WO2012/056252, WO2012/035342, WO2012/035343 and WO2012/095677.

The description and preferences described above for the first aspect of the invention are equally applicable to the second and third aspects of the invention.

The present invention will now be illustrated by reference to the following examples, without in any way limiting its scope.

EXAMPLES

1. Preparation of Cleaning Particles 1.1 Materials

The following materials were used to prepare the cleaning particles:

Ultramid® B40 which is a thermoplastic polyamide (Nylon-6) obtained from BASF SE having a viscosity number of 250 ml/g.

Ultramid® C33 which is a thermoplastic polyamide (a copolyamide of Nylon-6; Nylon-6,6) obtained from BASF SE having a viscosity number of 195 ml/g.

Ultramid® B27 is a thermoplastic polyamide (Nylon-6) obtained from BASF SE having a viscosity number of 150 ml/g.

The viscosity numbers were measured according to DIN ISO307 in all cases. The solvent is preferably 96% sulphuric acid.

Blanc Fixe® N is barium sulfate obtained from Sachtleben. This is used in the examples as the particulate inorganic filler. The density of this material is approximately 4.5 g/cm$^3$.

Portaryte® $D_{150}$ is barium sulfate obtained from Sibelco. The density of this material is approximately 4.5 g/cm$^3$.

Portaryte® B40/10 is barium sulfate obtained from Sibelco. The density of this material is approximately 4.5 g/cm$^3$.

The particle size distribution of the barium sulfate fillers have been measured by laser diffraction (Fraunhofer diffraction) using a Mastersizer 3000 from Malvern. The barium sulfate samples were dispersed in distilled water and dispersed by ultrasonication for 30 seconds. The particle size characteristics of the different barium sulfate fillers were as indicated in Table A. The particle sizes are volume-based.

TABLE A

Particle size characteristics of different barium sulfate materials

| | $D_{(V,10)}$ (μm) | $D_{(V,50)}$ (μm) | $D_{(V,90)}$(μm) | Span |
|---|---|---|---|---|
| Blanc Fixe ® N | 1.7 | 5.8 | 13.2 | 1.98 |
| Portaryte ® B40/10 | 8.8 | 15.8 | 26.5 | 1.12 |
| Portaryte ® D150 | 2.0 | 13.3 | 65.9 | 4.80 |

1.2 Extrusion

The thermoplastic and particulate inorganic filler were mixed and extruded using a twin-screw extruder at a melt temperature of from 270 to 340° C. The particulate inorganic filler was metered in using a side feed with a gravimetric metering balance. The twin-screw extruder was used to extrude the melt into a cutting chamber containing water as the liquid coolant. The cutting speeds and extrusion pressures were adjusted to obtain the desired average cleaning particle size of around 4 mm (measured as described herein). The extrusion method was as described in WO2004/080679 in Example 1.

A range of cleaning particles was prepared using different thermoplastics and different particulate inorganic fillers in different amounts as specified in Tables 1 and 2. In Tables 1 and 2 all amounts were in wt %.

In Tables 1 and 2 the average particle size and the average density refer to the cleaning particles resulting from the extrusion and were measured by the methods as previously described. The shape of the cleaning particles prepared by extrusion was visually assessed for undesirable characteristics such as snake skinning, tails, cutting edges and particle to particle non-uniformity.

TABLE 1

| | Comparative Example A | Example A | Example B | Example C | Example D |
|---|---|---|---|---|---|
| Sample Ref No | GM0951/12/12 | GM0951-12-11 | GMO951/16/03 | GM0951/16/04A | GM0951/16/04 |
| Ultramid ® B40 | 100 | — | — | — | — |

TABLE 1-continued

| | Comparative Example A | Example A | Example B | Example C | Example D |
|---|---|---|---|---|---|
| Ultramid ® B27 | — | — | 40 | 35 | 30 |
| Ultramid ® C33 | — | 50 | — | — | — |
| Blanc Fixe ® N | — | 50 | 60 | 65 | 70 |
| Portaryte ® D150 | — | — | — | — | — |
| Portaryte B40/10 | — | — | — | — | — |
| Shape | Excellent | Excellent | OK | OK | OK |
| Aspect ratio | 1.172 | 1.14 | 1.280 | 1.505 | 1.372 |
| MFR | 16.22 | | 34.28 | 31.28 | 20.41 |
| Average particle size (mm) | 4.009 | 4.008 | 4.622 | 4.623 | 4.333 |
| Average particle density (g/cm$^3$) | 1.13 | 1.78 | 2.01 | 2.15 | 2.31 |

TABLE 2

| | Example E | Example F | Example G | Example H | Example I |
|---|---|---|---|---|---|
| Sample Ref No | GM0951/16/05 | GM0951/16/09 | GMO951/16/06B | GM0951/16/08A | GM0951/16/28 |
| Ultramid ® B40 | — | — | — | — | — |
| Ultramid ® B27 | 40 | 35 | 30 | — | 30 |
| Ultramid ® C33 | — | — | — | 25 | — |
| Blanc Fixe ® N | — | — | — | — | — |
| Portaryte ® D150 | 60 | 65 | 70 | 75 | — |
| Portaryte ® B40/10 | — | — | — | — | 70 |
| Shape | Excellent | Excellent | Excellent | Excellent | OK |
| Aspect ratio | 1.048 | 1.086 | 1.10 | 1.162 | 1.26 |
| MFR | 80.29 | 83.55 | 100.31 | 54.08 | |
| Average particle size (mm) | 4.19 | 4.29 | 4.300 | 4.647 | 3.94 |
| Average particle density (g/cm$^3$) | 1.98 | 2.10 | 2.15 | 2.39 | 2.11 |

The assessment of the shape was done visually; the rating of "Excellent" corresponds to an ellipsoidal shape with an aspect ratio of <1.2, whilst the rating of "OK" corresponds to a more cylindrical shape with an aspect ratio of >1.2.

The density of the particles was measured using a pycnometer according to DIN ISO 1183-1:2012.

MFR is the Melt Flow Rate which is measured according to ISO 1133 at 260° C./5 Kg.

The aspect ratio was calculated using the preferred method mentioned above.

As can be seen in Tables 1 and 2 above the incorporation of a particulate inorganic filler having a density of at least 2.5 g/cm$^3$ has provided cleaning particles with improved density characteristics.

Examples A to D in Table 1 all incorporate a particulate inorganic filler having a $D_{50}$ particle size of less than 10 microns and a $D_{90}$ particle size of less than 40 microns. It was shown that as the wt % of this smaller particle size filler approached and extended above 60 wt % the particle shape/size characteristics of the resulting cleaning particles became less optimal for laundry applications. In particular, these cleaning particles exhibited some degree of defects including: snake skinning, tails, cutting edges and particle to particle non-uniformity in shape and size and showed shapes which were far from the desired smooth ellipsoidal shape. As the weight incorporation of the filler increased the aspect ratio soon became undesirably higher than 1.2, indicating that the particles were becoming more cylindrical and less ellipsoidal. It was noted that the cleaning particles with undesirable shape characteristics using Blanc® Fixe N also demonstrated significant variations in melt pressure and melt flow. No attempts to produce better shapes by varying the extrusion and cutting parameters were successful.

Examples E to H in Table 2 all incorporate a particulate inorganic filler having a $D_{50}$ particle size of at least 10 microns and having a $D_{90}$ particle size of at least 40 microns. In addition to the desirable density results in Table 1 it was surprisingly possible to obtain cleaning particles with wt % incorporation of the particulate inorganic filler which approached or exceeded 60 wt % and which had excellent shape characteristics. That is to say Examples E to H had smooth ellipsoidal shapes which were substantially free from snake skinning, tails, cutting edges and were uniform in shape and size. The improved ellipsoidal shape is evident from the improved aspect ratios of the cleaning particles which are all <=1.2. Thus, particles having the more desired shape and density characteristics for laundry applications were even better achieved.

Example I in Table 2 incorporates a particulate inorganic filler having a $D_{50}$ particle size of at least 10 micron and having a $D_{90}$ particle size of less than 40 microns. As can be seen the particle shape characteristics are intermediate between those of Examples A to D in Table 1 and those of Examples E to H in Table 2.

2 Cleaning 2.1 Cleaning Examples and Methods

The following cleaning particles as prepared in part 1 above were selected for cleaning experiments: Comparative Example A and Example G.

The cleaning experiments were triplicated for each cleaning particle using a Xeros washing apparatus as described in PCT patent publication WO 2011/098815 with a recommended dry laundry loading of 25 kg. The washing cycle was carried out using 20 kgs of a cotton flatware ballast. The washing cycle was run for 60 minutes at a temperature of 20° C. or 70 minutes at a temperature of 40° C. and using an 250 gms of Pack 1 cleaning formulation supplied by Xeros Ltd. 69 $m^2$ of surface area of cleaning particles were used in all cases. The liquid medium was water. The cleaning particles were recycled through the cleaning apparatus during the washing cycle for 10 minutes of the washing cycle for the 20° C. temperature and for 15 minutes of the washing cycle for the 40° C. temperature.

After each cleaning cycle the wash load was rinsed and the washing apparatus performed a separation cycle for a period of 30 minutes (both rinse and separation cycles).

To test the cleaning performance 5×WFK (Ref No PCMS-55 05-05x05) stain test sheets obtained from WFK Testgewebe GmbH were used for each type of cleaning particles in each of the triplicated cleaning experiments. The L*, a*, b* values of each stain were measured before and after cleaning using a spectrophotometer. For each type of cleaning particle the average delta E value was calculated according to CIE76.

2.2 Cleaning Results

TABLE 3

Cleaning results

| Cleaning Particles | Average delta E (all stains) 20° C. | Average delta E (all stains) 40° C. | Average delta E (sebum) 20° C. | Average delta E (oil/soot) 20° C. | Average delta E (sebum) 40° C. | Average delta E (oil/soot) 40° C. |
|---|---|---|---|---|---|---|
| Comparative Example A | 15.73 | 17.46 | 16.38 | 10.59 | 19.18 | 12.43 |
| Example G | 15.79 | 17.93 | 17.05 | 10.72 | 19.66 | 13.03 |

As can be seen the cleaning results were superior when the method of the present invention was performed using the cleaning particles of Example G as opposed to Comparative Example A.

3 Separation 3.1 Separation Examples and Method

The following cleaning particles as prepared in part 1 above were selected for separation experiments: Comparative Example A, Example A and Example G.

The separations experiments were repeated 5 times for each cleaning particle using a Xeros washing apparatus as described in PCT patent publication WO 2011/098815 with a recommended dry laundry loading of 25 kg. The washing cycle was carried out using 20 kgs of a ballast comprising long sleeved shirts each having a single pocket on the front. The washing cycle was run for 60 minutes at a temperature of 20° C. and using an 100 gms of Pack 1 cleaning formulation obtained from Xeros Ltd. 69 $m^2$ of surface area of cleaning particles were used in all cases. The liquid medium was water. The cleaning particles were recycled through the cleaning apparatus during the washing cycle for a total of 10 minutes.

In every case the wash load was rinsed and the separation cycle was run for 30 minutes (for both rinse and separation cycles).

After the end of the separation cycle each item of the ballast was taken out and any remaining (unseparated) cleaning particles were shaken into a large container. Once all the ballast had been shaken to remove all the cleaning particles the cleaning particles were dried and then counted. An average number of unseparated particles was calculated for all of the 5 washing experiments using each type of cleaning particle. The results are described in Table 4.

TABLE 4

Separation results

| Cleaning particles | Average number of particles unseparated |
|---|---|
| Comparative Example A | 604.0 |
| Example A | 442.6 |
| Example G | 249.2 |

As can be seen the separation results for the cleaning particles in Examples A and G using the method of the present invention were far superior to those obtained for the cleaning particles in Comparative Example A. This is highly desirable as the end user has far fewer unseparated cleaning particles to remove from the final wash.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise. Thus for example, a substrate means one or more substrates, similarly a cleaning composition means one or more cleaning compositions and a particulate inorganic filler means one or more particulate inorganic fillers.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for cleaning a substrate which is or comprises a textile, the method comprising agitating the substrate in the presence of a cleaning composition comprising:

i. cleaning particles comprising a thermoplastic polyamide and a particulate inorganic filler comprising barium sulfate, said particulate inorganic filler having a density of at least 2.5 g/cm$^3$, said cleaning particles having an average particle size of from 1 to 100 mm, wherein the cleaning particles have an average density of at least 1.65 g/cm$^3$; and ii. a liquid medium.

2. A method according to claim 1 wherein the particulate inorganic filler has a $D_{50}$ particle size of at least 10 microns and a $D_{90}$ particle size of at least 40 microns.

3. A method according to claim 1 wherein the particulate inorganic filler has a $D_{50}$ particle size of from 10 to 50 microns.

4. A method according to claim 3 wherein the particulate inorganic filler has a $D_{50}$ particle size of from 10 to 25 microns.

5. A method according to claim 1 wherein the particulate inorganic filler has a $D_{90}$ particle size of from 40 to 120 microns.

6. A method according to claim 1 wherein the particulate inorganic filler has a particle size distribution having a span calculated from the (D90–D10)/D50 of at least 2.5.

7. A method according to claim 1 wherein the cleaning particles have an average density of at least 1.9 g/cm$^3$.

8. A method according to claim 1 wherein cleaning particles have an average density of no more than 5.0 g/cm$^3$.

9. A method according to claim 8 wherein the cleaning particles have an average density of no more than 2.5 g/cm$^3$.

10. A method according to claim 1 wherein the particulate inorganic filler has a density of no more than 10 g/cm$^3$.

11. A method according to claim 1 wherein the particulate inorganic filler has a density of at least 4 g/cm$^3$.

12. A method according to claim 1 wherein the particulate inorganic filler further comprises one or more fillers selected from a metal salt, a metal oxide, a metal sulfide, a metal carbide, a metal nitride, a ceramic, a metal, an alloy and combinations thereof.

13. A method according to claim 12 wherein the particulate inorganic filler further comprises a metal salt, a metal oxide or a metal sulfide.

14. A method according to claim 13 wherein the particulate inorganic filler zinc sulfide.

15. A method according to claim 1 wherein the cleaning particles comprise at least 55 wt % of particulate inorganic filler.

16. A method according to claim 1 wherein the cleaning particles comprise no more than 80 wt % of particulate inorganic filler.

17. A method according to claim 1 wherein the thermoplastic polyamide comprises an aliphatic polyamide.

18. A method according to claim 17 wherein the aliphatic polyamide comprises Nylon 6, Nylon 6,6 or a mixture thereof.

19. A method according to claim 1 wherein the cleaning particles are in the form of a sphere, ellipsoid, cylinder or cuboid.

20. A method according to claim 1 wherein the cleaning particles have an average particle size of from 1 to 10 mm.

21. A method according to claim 1 wherein the liquid medium comprises water.

22. A method according to claim 1 wherein the substrate is selected from the group consisting of towels, clothes, sheets, footwear and bags.

23. A method according to claim 1 wherein the textile is selected from the group consisting of one or more fibres made of wool, cellulose, silk, nylon, polyester and acrylic.

24. A method according to claim 1 wherein the cleaning particles are re-used in further cleaning procedures according to the method.

25. A method according to claim 1 wherein the cleaning particle have an aspect ratio, in order of less than or equal to 1.20.

26. A method according to claim 1, wherein the particulate inorganic filler has a D50 particle size of at least 10 microns or a D90 particle size of at least 40 microns.

* * * * *